United States Patent [19]

Davis, Jr.

[11] 4,137,518

[45] Jan. 30, 1979

[54] RESISTANCE DISK

[76] Inventor: George B. Davis, Jr., 7512 Marbury Rd., Bethesda, Md. 20034

[21] Appl. No.: 826,899

[22] Filed: Sep. 6, 1977

[51] Int. Cl.[2] ..... H01C 10/26

[52] U.S. Cl. ..... 338/150; 29/620; 338/142; 338/308; 427/102; 427/103

[58] Field of Search ..... 338/89, 90, 92, 97, 338/150, 138, 139, 142, 307, 308-309; 29/610, 620; 427/101, 102, 103, 123

[56] References Cited

U.S. PATENT DOCUMENTS 3,379,567 4/1968 Wright ..... 338/89

3,676,823 7/1972 Fujii et al. ..... 338/92 X 3,723,938 3/1973 Gramm ..... 338/92 X

FOREIGN PATENT DOCUMENTS 771778 7/1934 France ..... 338/139

*Primary Examiner*—C. L. Albritton

[57] ABSTRACT

This invention relates generally to electrical resistors and particularly to a resistor disk and contact assembly wherein by reason of the structure of the disk, the radial resistance of the disk is randomly varied to produce a random-like resistance pattern of a predetermined configuration as the disk is rotated between fixed engaging contacts.

3 Claims, 3 Drawing Figures

FIG. 1
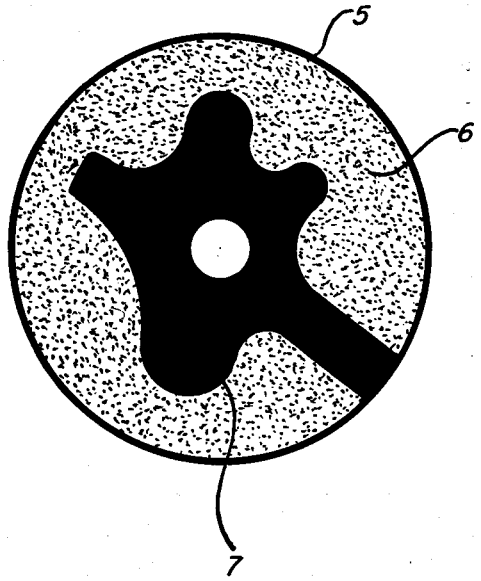
FIG. 3
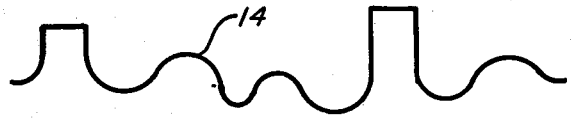
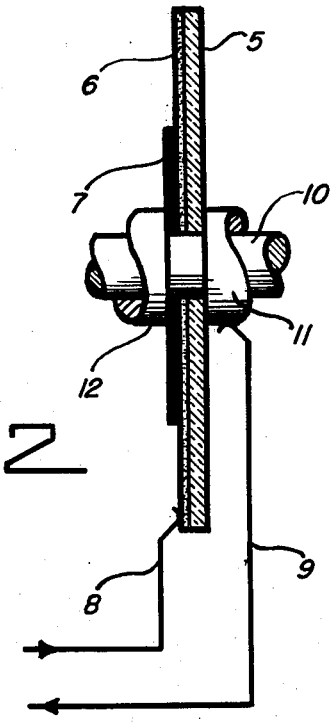
FIG. 2

RESISTANCE DISK

The present device provides for varying in random-like manner the radial resistance of a resistor coated disk by selectively shorting out radially and in accordance with a predetermined pattern random-like radial areas of the resistance coating upon the disk and primary for use within low current applications such as within the gating circuit of an SCR, Triac and Disc or within a similar operating transistor circuit.

An object of the present invention is to provide a resistor disk and contact assembly whereby the resistance from an electrical source may be randomly varied in accordance with a predetermined random-like pattern by rotation of the disk about its axis.

A further object is to provide a resistance disk wherein the resistance between radially extending surfaces of the disk may be selectively varied in a manner to produce random-like resistance changes between fixed contact members electrically engaging the surface of the disk.

Further objects and advantages of the present device will become more apparent by referring to the following specification and drawings wherein:

FIG. 1 is a plain view of the preferred embodiment of the resistance disk showing the electrically shorted out areas of the resistance coating upon the disk.

FIG. 2 is a side view of the disk as mounted for rotation about its axis and as electrically engaged by contacting members electrically contacting the resistance and conductive surfaces upon the disk.

FIG. 3 shows substantually the varied and random-like resistance pattern as would be produced by a single rotation of the disk about its transverse axis.

Referring now to the drawings and particularly to FIGS. 1 and 2 thereof wherein is shown a disk 5 formed preferably of plastic and upon which has been deposited or otherwise applied a coating of resistance material 6. Within the center of the disk has been applied a coating or overlay of highly conductive material 7 and in such a manner as to effectively short out selectively, radial areas of the resistance surface of the disk and in such a manner that as the disk is rotated between the fixed contacts 8 and 9, in electrical contact with the disk, a random-like resistance patterns is produced across the contacts 8 and 9 that may be selectively varied to any configuration by the overlay and by a single rotation of the disk.

Here, rotation of the disk is effected by rotation of shaft 10 that forms a part of any suitable drive source and upon which the disk 5 is clamped for rotation between conductive collars 11 and 12.

While herein is shown in FIG. 3 one example of a resistance pattern 14 as may be produced by a single revolution of the disk 5, it will be understood that this resistance pattern may be varied selectively and in a random manner by varying the pattern of the overlay 7 which operates to alter selectively the radial resistance of the disk.

While herein is shown a resistance disk and contact assembly that has been found reliable and inexpensive to manufacture, it is understood that the arrangement may be modified without departing from the spirit and scope of the device as herein shown.

What I therefore claim and desire to cover by letters patent is:

1. A variable resistor assembly including in combination, a nonconductive plate having thereon a randomly configured radially varying resistance surface and rotatable about a transverse axis, at least two spaced substantially fixed contact members electrically engaging the resistance surface of said plate and so disposed with respect to each other that substantially only the radial resistance of the resistance surface upon the disk is applied between the contacts whereby the resistance pattern between said contacts is caused to continually vary in a gradual and random-like manner by rotation of the disk between said contacts.

2. A variable resistor assembly including in combination an insulating disk, rotatable about a transverse axis, a resistance coating disposed upon said disk to form a relatively high resistance surface upon the disk, a highly conductive overlay disposes upon said disk in a manner electrically shorting out a portion of said resistance surface and with the edge of said highly conductive overlay including an irregular and random-like configurated edge where intersecting the exposed portion of said resistance surface, at least one substantially fixed contact member electrically engaging the exposed resistance surface upon said disk, a second substantially fixed contact member electrically engaging the said highly conductive overlay upon said disk whereby as the disk is rotated, there is produced between the contacts a continually varying and random-like pattern of resistance changes as applied substantially radially to the contacts from the disk's surface.

3. A variable resistor assembly including in combination an insulating plate rotatable about a transverse axis, a resistance coating disposed upon said plate and including an irregular and random-like configurated edge, a highly conductive coating disposed upon said plate and electrically engaging the random-like and varying edge of said resistance coating, at least one substantially fixed contact member electrically engaging the resistance coating upon said plate, at least one contact member electrically engaging the said highly conductive coating upon said plate whereby as the disk is rotated about its axis, there is produced between the contacts a continually varying and random-like pattern of resistance changes as applied substantially radially to the contacts from the resistance surfaces upon said plate.

* * * * *